US007934319B2

(12) United States Patent
Peterson et al.

(10) Patent No.: US 7,934,319 B2
(45) **Date of Patent: *May 3, 2011**

(54) PENCIL-SHARPENING DEVICE

(75) Inventors: Michael E. Peterson, Fairfield, CT (US); Larry Buchtmann, Goldsboro, NC (US); Walter Johnsen, Fairfield, CT (US); Stuart D. Farnworth, Westport, CT (US)

(73) Assignee: Acme United Corporation, Fairfield, CT (US)

( * ) Notice: Subject to any disclaimer, the term of this patent is extended or adjusted under 35 U.S.C. 154(b) by 273 days.

This patent is subject to a terminal disclaimer.

(21) Appl. No.: 11/557,806

(22) Filed: Nov. 8, 2006

(65) Prior Publication Data

US 2007/0214661 A1 Sep. 20, 2007

Related U.S. Application Data

(63) Continuation-in-part of application No. 11/231,151, filed on Sep. 20, 2005, which is a continuation-in-part of application No. 10/720,578, filed on Nov. 24, 2003, now Pat. No. 6,988,318, application No. 11/557,806, which is a continuation of application No. 11/231,259, filed on Sep. 20, 2005, now abandoned, and a continuation of application No. 11/337,968, filed on Jan. 23, 2006, now abandoned, and a continuation of application No. 11/337,976, filed on Jan. 23, 2006, and a continuation of application No. 11/337,789, filed on Jan. 23, 2006, now abandoned.

(60) Provisional application No. 60/734,499, filed on Nov. 8, 2005.

(51) Int. Cl.
*B26B 9/00* (2006.01)

(52) U.S. Cl. ..... 30/350; 30/346; 30/453; 428/457

(58) Field of Classification Search ..... 30/346, 30/346.53, 346.54, 350, 453; 428/457, 697, 428/698, 699; 76/104.1
See application file for complete search history.

(56) References Cited

U.S. PATENT DOCUMENTS

| | | | |
|---|---|---|---|
| 437,468 | A | 9/1890 | Wheeler |
| 1,740,395 | A | 12/1929 | Durst |
| 1,941,215 | A | 12/1933 | Liggio |
| 2,103,217 | A | 12/1937 | Ford |
| 2,214,890 | A | 9/1940 | Rhodes, Jr. |

(Continued)

FOREIGN PATENT DOCUMENTS

| | | |
|---|---|---|
| DE | 3447962 | 11/1985 |

(Continued)

OTHER PUBLICATIONS

Modern Machine Shop, Multiple Layer Coatings Keep Microcracks from Destroying Inserts, posted on Jan. 15, 1999, http://www.mmsonline.com/articles/multiple-layer-coatings-keep-microcracks-from-destr...; printed Nov. 21, 2008.

(Continued)

*Primary Examiner* — Hwei-Siu C Payer
(74) *Attorney, Agent, or Firm* — Alix, Yale & Ristas, LLP

(57) ABSTRACT

The present invention is directed to a pencil-sharpening device having a titanium chromium nitride coating disposed on the cutting blade of the device. The titanium chromium nitride coating is metallurgically bonded to the steel blade. The coated blade provides enhanced properties for the pencil-sharpening device.

18 Claims, 5 Drawing Sheets

U.S. PATENT DOCUMENTS

| | | | | |
|---|---|---|---|---|
| 2,270,473 | A | 1/1942 | Porcelli | |
| 2,408,767 | A | 10/1946 | Fleming | |
| 2,561,438 | A | 7/1951 | Duchesneau | |
| 2,822,781 | A | 2/1958 | Burton | |
| 3,004,522 | A | 10/1961 | Kent | |
| 3,175,539 | A | 3/1965 | Saflund et al. | |
| 3,467,843 | A | 9/1969 | Dailey | |
| 3,490,324 | A | 1/1970 | Dahle | |
| 3,595,285 | A | 7/1971 | Ruben | |
| 3,678,975 | A | 7/1972 | Imanishi et al. | |
| 3,776,286 | A | 12/1973 | Blanck | |
| 3,777,791 | A | 12/1973 | Uchida | |
| 3,792,636 | A | 2/1974 | Pottern | |
| 3,874,900 | A | 4/1975 | Post et al. | |
| 3,889,730 | A | 6/1975 | Buc | |
| 3,937,239 | A | 2/1976 | Bosland | |
| 3,988,955 | A | 11/1976 | Engel et al. | |
| 4,007,524 | A | 2/1977 | Hannes et al. | |
| 4,046,044 | A | 9/1977 | Paterson et al. | |
| 4,050,487 | A | 9/1977 | Mabuchi et al. | |
| 4,431,038 | A | 2/1984 | Rome | |
| 4,436,830 | A | 3/1984 | Andreev et al. | |
| 4,450,205 | A | 5/1984 | Itaba et al. | |
| 4,469,489 | A | 9/1984 | Sarin | |
| 4,470,895 | A | 9/1984 | Coad et al. | |
| 4,601,316 | A | 7/1986 | Verdi | |
| 4,670,172 | A | 6/1987 | Sproul et al. | |
| 4,685,366 | A | 8/1987 | Beder | |
| 4,698,266 | A | 10/1987 | Buljan | |
| 4,755,237 | A | 7/1988 | Lemelson | |
| 4,815,507 | A | 3/1989 | O'Rourke | |
| D305,248 | S | 12/1989 | Ukisu | |
| 4,892,792 | A | 1/1990 | Sarin | |
| D306,551 | S | 3/1990 | Yuen | |
| 4,933,058 | A | 6/1990 | Bache et al. | |
| D311,027 | S | 10/1990 | Yuen | |
| 4,966,208 | A | 10/1990 | Uang | |
| 4,981,756 | A | 1/1991 | Rhandhawa | |
| 4,984,492 | A | 1/1991 | Gerber | |
| 5,027,684 | A | 7/1991 | Neukam | |
| D320,812 | S | 10/1991 | Yuen | |
| 5,052,453 | A | 10/1991 | Chen | |
| D324,184 | S | 2/1992 | Benech | |
| D324,700 | S | 3/1992 | Shimoo et al. | |
| 5,120,596 | A * | 6/1992 | Yamada | 428/698 |
| 5,152,774 | A | 10/1992 | Schroeder | |
| 5,162,147 | A | 11/1992 | Ruppi | |
| D333,839 | S | 3/1993 | Kiyokane | |
| D335,308 | S | 5/1993 | Shapiro et al. | |
| D336,124 | S | 6/1993 | Ordlock | |
| 5,219,354 | A | 6/1993 | Choudhury et al. | |
| D339,536 | S | 9/1993 | Ribron | |
| 5,301,431 | A | 4/1994 | Cera | |
| 5,322,001 | A | 6/1994 | Boda | |
| D354,987 | S | 1/1995 | Yuen | |
| 5,379,817 | A | 1/1995 | O'Neil et al. | |
| 5,476,134 | A | 12/1995 | Whittle et al. | |
| 5,477,616 | A | 12/1995 | Williams et al. | |
| D367,618 | S | 3/1996 | Stewart et al. | |
| 5,525,420 | A | 6/1996 | Kaufmann | |
| 5,528,833 | A | 6/1996 | Sakuma | |
| 5,584,845 | A | 12/1996 | Hart | |
| D377,666 | S | 1/1997 | Yuen | |
| D378,834 | S | 4/1997 | Yuen | |
| D378,835 | S | 4/1997 | Guerrero | |
| D383,165 | S | 9/1997 | Gstalder | |
| D383,783 | S | 9/1997 | Jeter et al. | |
| 5,671,647 | A | 9/1997 | Mori | |
| D387,091 | S | 12/1997 | Anderson | |
| 5,700,094 | A | 12/1997 | Dam | |
| D388,828 | S | 1/1998 | Robinson et al. | |
| D390,264 | S | 2/1998 | Singleton et al. | |
| 5,724,868 | A | 3/1998 | Knudsen et al. | |
| 5,746,586 | A | 5/1998 | Fukuhara | |
| D396,062 | S | 7/1998 | White et al. | |
| D396,886 | S | 8/1998 | de Melo et al. | |
| D397,048 | S | 8/1998 | Herndon | |
| D402,314 | S | 12/1998 | Lidle, Jr. et al. | |
| D405,830 | S | 2/1999 | Mak | |
| D406,173 | S | 2/1999 | Chen | |
| D409,102 | S | 5/1999 | Balliette | |
| D412,344 | S | 7/1999 | Clark | |
| D417,238 | S | 11/1999 | Huang | |
| 5,983,507 | A | 11/1999 | Hirai | |
| D417,693 | S | 12/1999 | Daley, Jr. | |
| 5,996,459 | A | 12/1999 | Cornell et al. | |
| D418,874 | S | 1/2000 | Shapiro | |
| D420,390 | S | 2/2000 | Donaldson | |
| D422,313 | S | 4/2000 | Chen | |
| D423,585 | S | 4/2000 | Chen | |
| D425,560 | S | 5/2000 | Yuen | |
| 6,065,514 | A | 5/2000 | New | |
| D426,852 | S | 6/2000 | Gstalder | |
| 6,076,264 | A | 6/2000 | Meckel | |
| 6,098,515 | A | 8/2000 | Daley, Jr. | |
| D431,263 | S | 9/2000 | Greenhouse | |
| 6,189,218 | B1 | 2/2001 | Okada | |
| D441,796 | S | 5/2001 | Chan | |
| D442,993 | S | 5/2001 | Eisen | |
| 6,249,981 | B1 | 6/2001 | Shu | |
| D445,833 | S | 7/2001 | Fonfeder | |
| D449,072 | S | 10/2001 | Bennett | |
| 6,309,738 | B1 | 10/2001 | Sakurai | |
| D451,961 | S | 12/2001 | Shapiro | |
| 6,330,750 | B1 | 12/2001 | Meckel | |
| D453,188 | S | 1/2002 | Fonfeder | |
| D454,159 | S | 3/2002 | Tsuchikura | |
| 6,372,369 | B1 * | 4/2002 | Ito et al. | 428/698 |
| 6,391,457 | B1 | 5/2002 | Wetty | |
| D460,115 | S | 7/2002 | Sawyer | |
| D460,116 | S | 7/2002 | Gstalder | |
| 6,422,110 | B1 | 7/2002 | Wurst et al. | |
| D461,206 | S | 8/2002 | Gstalder | |
| 6,460,443 | B1 | 10/2002 | Hsiao | |
| 6,470,929 | B2 | 10/2002 | Fregeolle | |
| D466,940 | S | 12/2002 | Gstalder | |
| 6,492,011 | B1 | 12/2002 | Brandle et al. | |
| 6,497,772 | B1 | 12/2002 | Meckel et al. | |
| D469,809 | S | 2/2003 | Gstalder | |
| D470,182 | S | 2/2003 | Gstalder | |
| D470,183 | S | 2/2003 | Gstalder | |
| D470,889 | S | 2/2003 | Daley, Jr. | |
| 6,540,451 | B1 | 4/2003 | Mori | |
| 6,553,882 | B1 | 4/2003 | Daley, Jr. et al. | |
| D474,508 | S | 5/2003 | Lammers et al. | |
| 6,565,957 | B2 | 5/2003 | Nakamura | |
| D477,017 | S | 7/2003 | Vossler et al. | |
| D477,847 | S | 7/2003 | Gosse | |
| D480,110 | S | 9/2003 | Lin | |
| 6,617,057 | B2 | 9/2003 | Gorokhovsky et al. | |
| 6,637,481 | B2 | 10/2003 | Mak et al. | |
| 6,675,689 | B2 | 1/2004 | Nunez et al. | |
| D489,094 | S | 4/2004 | Bodum | |
| 6,730,392 | B2 | 5/2004 | Vetter et al. | |
| D494,222 | S | 8/2004 | Berry | |
| 6,845,795 | B2 | 1/2005 | Lamers et al. | |
| 6,866,921 | B2 | 3/2005 | Grab et al. | |
| 6,884,240 | B1 * | 4/2005 | Dykes | 606/1 |
| 6,886,614 | B2 | 5/2005 | Ricono et al. | |
| 6,929,851 | B1 | 8/2005 | Leverenz et al. | |
| 6,988,318 | B2 | 1/2006 | Buchtmann et al. | |
| 7,008,688 | B2 | 3/2006 | Toihara | |
| 7,037,587 | B2 | 5/2006 | Lin | |
| 7,140,113 | B2 | 11/2006 | King et al. | |
| 2002/0096031 | A1 | 7/2002 | Yang | |
| 2003/0070305 | A1 | 4/2003 | Oshika et al. | |
| 2003/0140757 | A1 | 7/2003 | Carlson et al. | |
| 2003/0140761 | A1 | 7/2003 | Schulz | |
| 2003/0154835 | A1 | 8/2003 | Nunez et al. | |
| 2004/0142205 | A1 | 7/2004 | Chen | |
| 2004/0168324 | A1 | 9/2004 | Buchtmann et al. | |
| 2004/0234704 | A1 | 11/2004 | Garg | |
| 2005/0255329 | A1 | 11/2005 | Hazel et al. | |
| 2006/0095060 | A1 | 5/2006 | Mayenberger et al. | |
| 2008/0178476 | A1 * | 7/2008 | Luttgens | 30/346.54 |
| 2009/0013538 | A1 * | 1/2009 | Constantine et al. | 30/254 |

FOREIGN PATENT DOCUMENTS

| | | | |
|---|---|---|---|
| EP | 0095128 | A1 | 11/1983 |
| EP | 0095130 | A1 | 11/1983 |
| EP | 0095131 | A1 | 11/1983 |
| EP | 801144 | A1 | 10/1997 |
| EP | 0846538 | A2 | 6/1998 |
| JP | 62-181836 | | 8/1987 |
| JP | 1047849 | | 2/1989 |
| JP | 2080901 | | 3/1990 |
| JP | 4-114689 | | 4/1992 |
| JP | 5-068754 | | 3/1993 |
| JP | 5-084363 | | 4/1993 |
| JP | 5-146558 | | 6/1993 |
| JP | 7268660 | | 10/1995 |
| JP | 10168583 | | 6/1998 |
| JP | 2005097651 | | 4/2005 |
| WO | 9418354 | A1 | 8/1994 |
| WO | WO03/041919 | | 5/2003 |
| WO | 2005061410 | A1 | 7/2005 |
| WO | 2007/035807 | A2 | 3/2007 |

OTHER PUBLICATIONS

Madorsky et al., Coating for stamping and forming tools, Mar. 8, 2005, http://www.thefabricator.com/Printer_Friendly_Article.cfm?ID=1058, printed Nov. 21, 2008.

Tooling & Production, Coating Technology Takes Another Quantum Leap, http://www.manufacturingcenter.com/tooling/archives/0399/399quan.asp, printed Aug. 7, 2006.

Surviliene, et al., Surface & Coatings Technology, 176, 2004, pp. 193-201.

Zimmermann, Oberflachen-Polysurfaces No. 4, vol. 41, 2000, pp. 14-19.

Veprek, et al., Surface Engineering: Science and Technology I,The Minerals, Metals and Materials Society, 1999, pp. 219-231.

Chen, et al., Surface Engineering: Science and Technology I, The Minerals, Metals and Materials Society, 1999, pp. 379-384.

Lugscheider, et al., Surface Engineering: Science and Technology I, The Minerals, Metals and Materials Society, 1999, pp. 405-414.

Holleck, Surface Engineering: Science and Technology I, The Minerals, Metals and Materials Society, 1999, pp. 207-218.

Zhang, et al., Surface and Coatings Technology, 167, 2003, pp. 113-119.

Nonfinal Office Action mailed Oct. 16, 2007 for U.S. Appl. No. 11/231,151, filed Sep. 20, 2005.

Final Office Action mailed Aug. 26, 2008 for U.S. Appl. No. 11/231,151, filed Sep. 20, 2005.

Nonfinal Office Action mailed May 1, 2008 for U.S. Appl. No. 11/337,789, filed Jan. 23, 2006.

Final Office Action mailed May 21, 2009 for U.S. Appl. No. 11/337,789, filed Jan. 23, 2006.

Nonfinal Office Action mailed Dec. 28, 2006 for U.S. Appl. No. 11/337,976, filed Jan. 23, 2006.

Nonfinal Office Action mailed Oct. 16, 2007 for U.S. Appl. No. 11/337,976, filed Jan. 23, 2006.

Final Office Action mailed Jun. 27, 2008 for U.S. Appl. No. 11/337,976, filed Jan. 23, 2006.

Nonfinal Office Action mailed Jul. 3, 2008 for U.S. Appl. No. 11/231,259, filed Sep. 20, 2005.

Final Office Action mailed Mar. 11, 2009 for U.S. Appl. No. 11/231,259, filed Sep. 20, 2005.

* cited by examiner

PENCIL-SHARPENING DEVICE

CROSS-REFERENCE TO RELATED APPLICATIONS

This application claims the benefit of U.S. Provisional Patent Application No. 60/734,499, entitled "Pencil-Sharpening Device" filed on Nov. 8, 2005, which is incorporated by reference herein. This application also claims priority under 35 U.S.C. §120 from U.S. application Ser. No. 11/231,151 filed on Sep. 20, 2005, incorporated herein in its entirety, which is a continuation-in-part application that claims priority to U.S. Pat. No. 6,988,318, issued Jan. 24, 2006, which claims priority to U.S. Application No. PCT/US02/36314, filed Nov. 13, 2002, which claims priority to U.S. Provisional Application No. 60/338,575, filed Nov. 13, 2001, the entirety of which are incorporated by reference herein. This application is related to and incorporates by reference continuation U.S. application Ser. Nos. 11/231,259, filed Sep. 20, 2005 , which claims priority to U.S. Pat. No. 6,988,318, issued Jan. 24, 2006. This application is related to and incorporates by reference continuation U.S. application Ser. Nos. 11/337,968, 11/337,976, and 11/337,789, each of which claims priority to U.S. Pat. No. 6,988,318, issued Jan. 24, 2006, which claims priority to U.S. Application No. PCT/US02/36314, filed Nov. 13, 2002, which claims priority to U.S. Provisional Application No. 60/338,575, filed Nov. 13, 2001. This application is related to and incorporates by reference U.S. application Ser. No. 11/451,753, filed Jun. 12, 2006, which claims priority to U.S. Provisional Application No. 60/692,906.

FIELD OF THE INVENTION

The present invention generally relates to writing instrument sharpening devices. In particular, the present invention relates to pencil sharpening devices having a coated blade.

BACKGROUND OF THE INVENTION

Manually operated and electrically powered pencil sharpeners are well known. When a pencil is inserted through a pencil-receiving aperture of a pencil sharpener's housing, the pencil enters a sharpening assembly, which cuts an outer layer typically composed of wood. The cutting process exposes and sharpens an inner core, which is often composed of graphite.

Typically, electric pencil sharpeners have a sharpening assembly including a rotary mechanism, which is rotated by a motor and cutter mechanism, which is operated by the rotary mechanism. The rotary mechanism and cutter mechanism typically rotate in relatively opposite direction. Most pencil sharpeners carry a cutting blade or plurality of cutting blades on the rotary mechanism.

Blades in pencil sharpeners are typically used to sharpen pencils with varying hardness. The combination of graphite, wood, and composite materials in pencils wear down the pencil sharpener blades resulting in increasingly dull blades and increased blade surface roughness through normal use. Pencil sharpeners are also often manipulated by young users who may knowingly or unknowingly damage the sharpener by inserting into the pencil-receiving aperture inappropriate objects that are much harder than pencils, such as pens, paperclips and mechanical pencils. The surface roughness and sharpness of the blades may be negatively affected by the insertion of such inappropriate objects. Dulled blades and increased surface roughness often result in deleterious effects to the writing instruments being sharpened. For example, as the pencil sharpener blades dull and the surface roughness increases, the smoothness of the cut, sharpness of the pencil tip and uniformity of the cut may be deleteriously affected. Pencil shavings and graphite particles often adhere more so to the surface of pencil sharpener blades that have been dulled and have greater surface roughness.

Typically, pencil sharpeners are heavily used mechanical devices, especially in schooling and drafting environments. Over time, as in the case with most heavily used mechanical devices, the mechanical elements of pencil sharpeners become worn.

It would be desirable for a pencil sharpener to have a blade with increased durability to regular and inappropriate use. It would be further desirable for a pencil sharpener to have a blade that would stay sharper longer while deterring the adherence of pencil shavings and graphite particles to the blade surface. It would be further desirable for a pencil sharpening blade to resist an increase in surface roughness through normal and abnormal use.

BRIEF SUMMARY OF THE INVENTION

In one aspect, the present invention generally provides a pencil sharpening device with a cutting blade that has a cutting edge. A coating is disposed on the cutting blade, in which the coating has about 35 percent by weight of titanium nitride and about 65 percent by weight of chromium nitride.

In an alternative embodiment, the invention generally provides a pencil sharpening device with a cutting blade that has a cutting edge. A coating is disposed on the cutting blade, in which the coating has about 35 percent by weight of titanium nitride and about 65 percent by weight of chromium nitride. The coating has a thickness in a range between about 0.3 and 0.5 microns, and a hardness in a range between about 5.7 to about 9.1 gigapascals.

In an alternative embodiment, the present invention generally provides a method for coating a pencil sharpening blade. The blade is placed within a coating chamber and then it is cleaned. After cleaning, a coating is deposited on the pencil sharpening blade. The coating has a range of about 25 to 50 percent by weight titanium nitride and a range of about 50 to 75 percent by weight chromium nitride.

In an alternative embodiment, the present invention generally provides a pencil-sharpening device with a cutting blade that has a cutting edge. A coating is disposed on the cutting blade, in which the coating provides the blade with a satin silver appearance.

BRIEF DESCRIPTION OF THE DRAWINGS

Preferred embodiments of the invention are described below with reference to the following drawings, which are provided for illustrative purposes only. The drawings illustrate a best mode presently contemplated for carrying out the invention.

In the drawings.

DETAILED DESCRIPTION OF THE INVENTION

Figure 1:
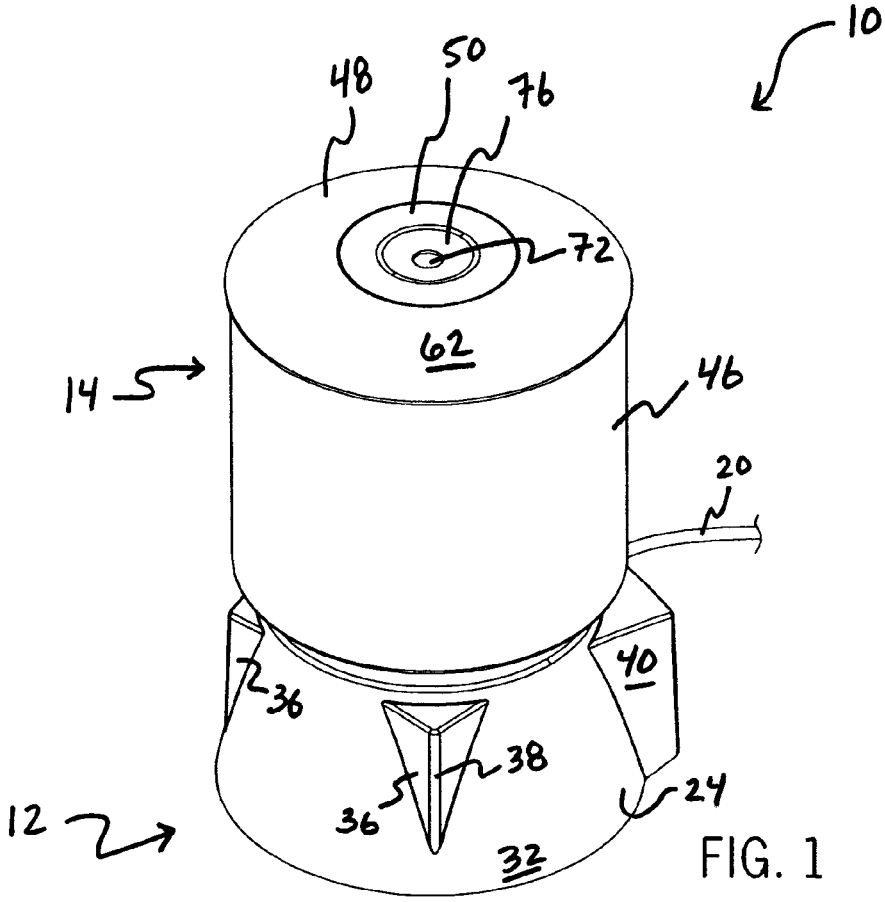
FIG. 1 is a perspective view of the pencil-sharpening device, according to one embodiment of the invention.

Reference will now be made in greater detail to various embodiments of the invention, one or more examples of which are illustrated in the drawings. Each example is provided by way of explanation of the invention and not meant as a limitation of the invention. The present invention is shown and described in its intended use and orientation. In the case where an element is not drawn to scale, the scale at which it is depicted is intended for identification and clarification purposes only.

Figure 2:
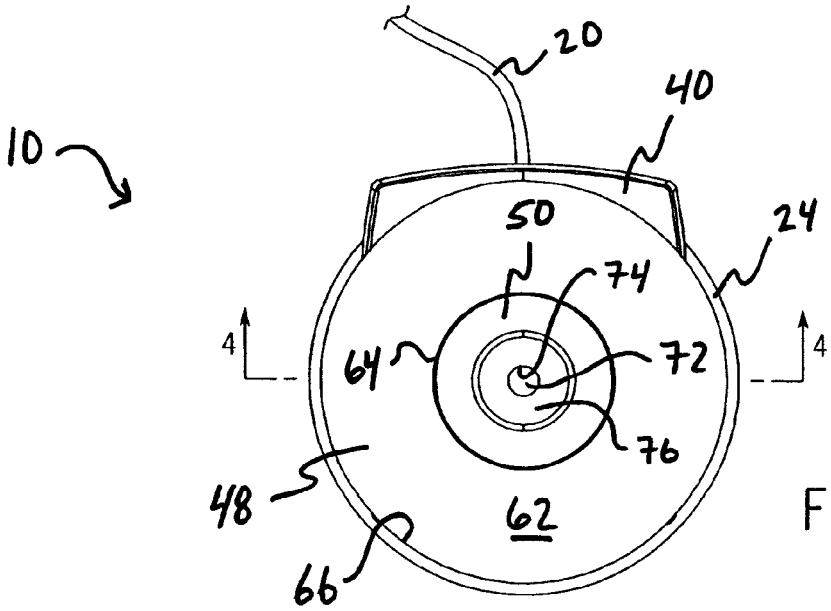
FIG. 2 is a top plan view of the pencil-sharpening device of FIG. 1.
Figure 3:
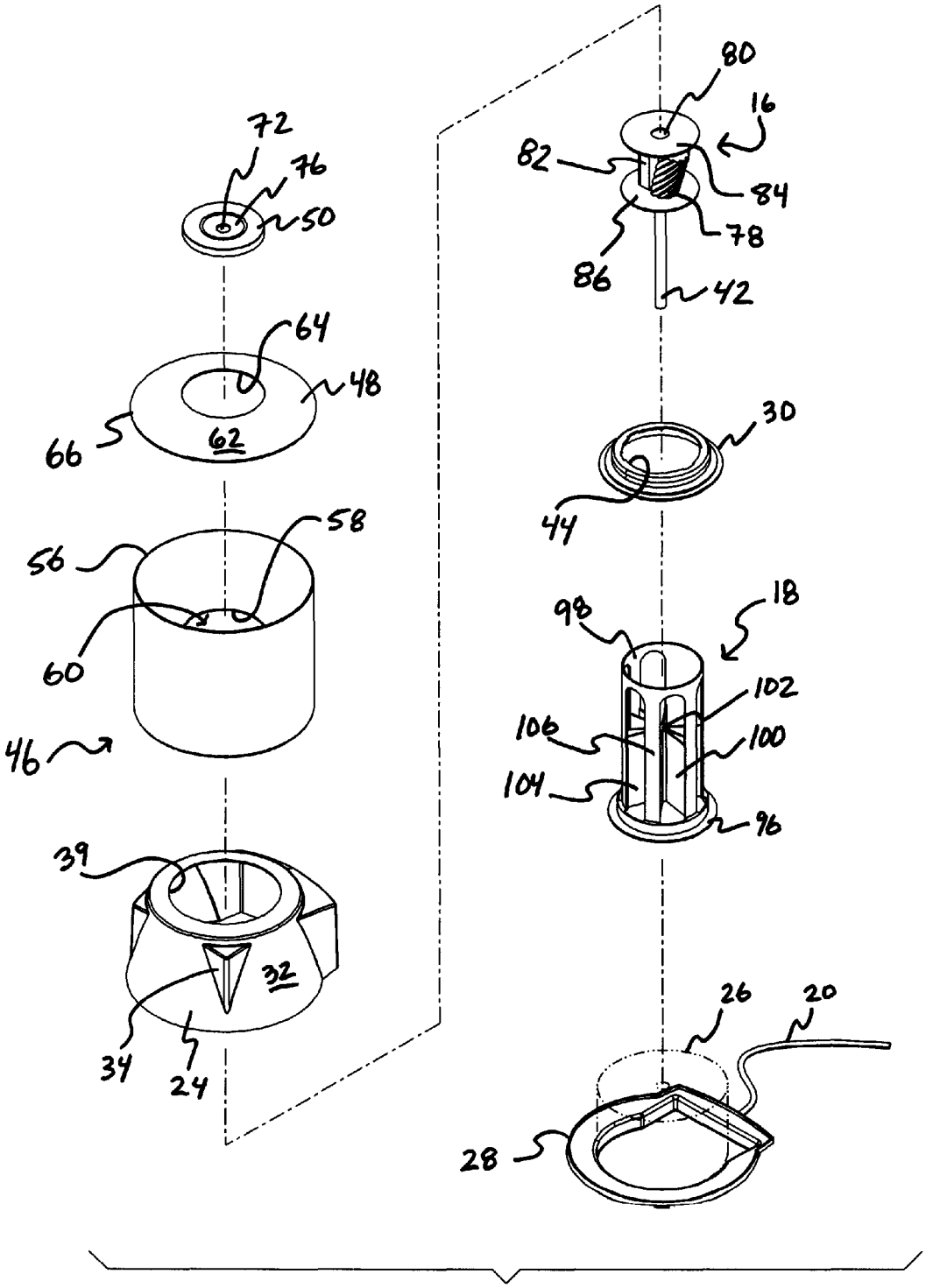
FIG. 3 is an exploded view of the pencil-sharpening device of FIG. 1.

Referring to FIGS. 1-3, one exemplary embodiment of a pencil-sharpening device 10 is provided for use in sharpening pencils. All variations of pencil-sharpening devices are equally appropriate for use with this invention, and are not limited to the examples provided. The device 10 is an electrical pencil sharpener that has a base 12, a housing assembly 14, a blade assembly 16, an assembly spacer 18, and power cord 20. The device 10 is repositionable based upon the needs of the user and may use a portable power source (not shown) rather than a power cord 20 tethered to a suitable electrical outlet (not shown). The embodiment of the device 10 as shown is preferably positioned upon a level surface 22 (See FIG. 4). A suitable mounting apparatus (not shown) may be used for mounting the device 10 to a surface 22 that is not level.

The base 12 of the device 10 has a base structure 24, a motor assembly 26, a motor assembly base 28, and a housing spacer 30. The base structure 24 has any desired shape, for example, the conical shape shown and may be composed a semi-conical shape and is composed of a durable and light-weight material such as plastic. Disposed upon an exterior surface 32 of the base structure 24 are two semi-pyramidal-shaped extensions 34. The extensions 34 provide three additional gripping surfaces 36 and edges 38 that aid in the repositioning of the device 10. In addition to the extensions 34 the base structure 24 has a base overlay 40. An aperture is formed in the base 12 and defined by an edge 39.

The motor assembly 26 is secured firmly to the motor assembly base 28. The motor assembly 26 houses an electric motor (not shown) that actuates a shaft 42 of the blade assembly 16. Any low-power electric motor that rotatably actuates a shaft would be suitable for use in the present invention.

The housing spacer 30 is a substantially circular piece of molded plastic having an aperture defining edge 44. The spacer 30 provides a means for spacing and connecting the base 12 to the housing assembly 14.

The housing assembly 14 has a receptacle 46, a housing cover 48 and a pencil guide 50. The receptacle 46 is vertically spaced above the base 12 and spacer 30. The receptacle 46 has a pencil-shaving receiving chamber 52, an exterior wall 54, an interior wall 56 (see FIG. 4), and an edge 58.

Figure 4:
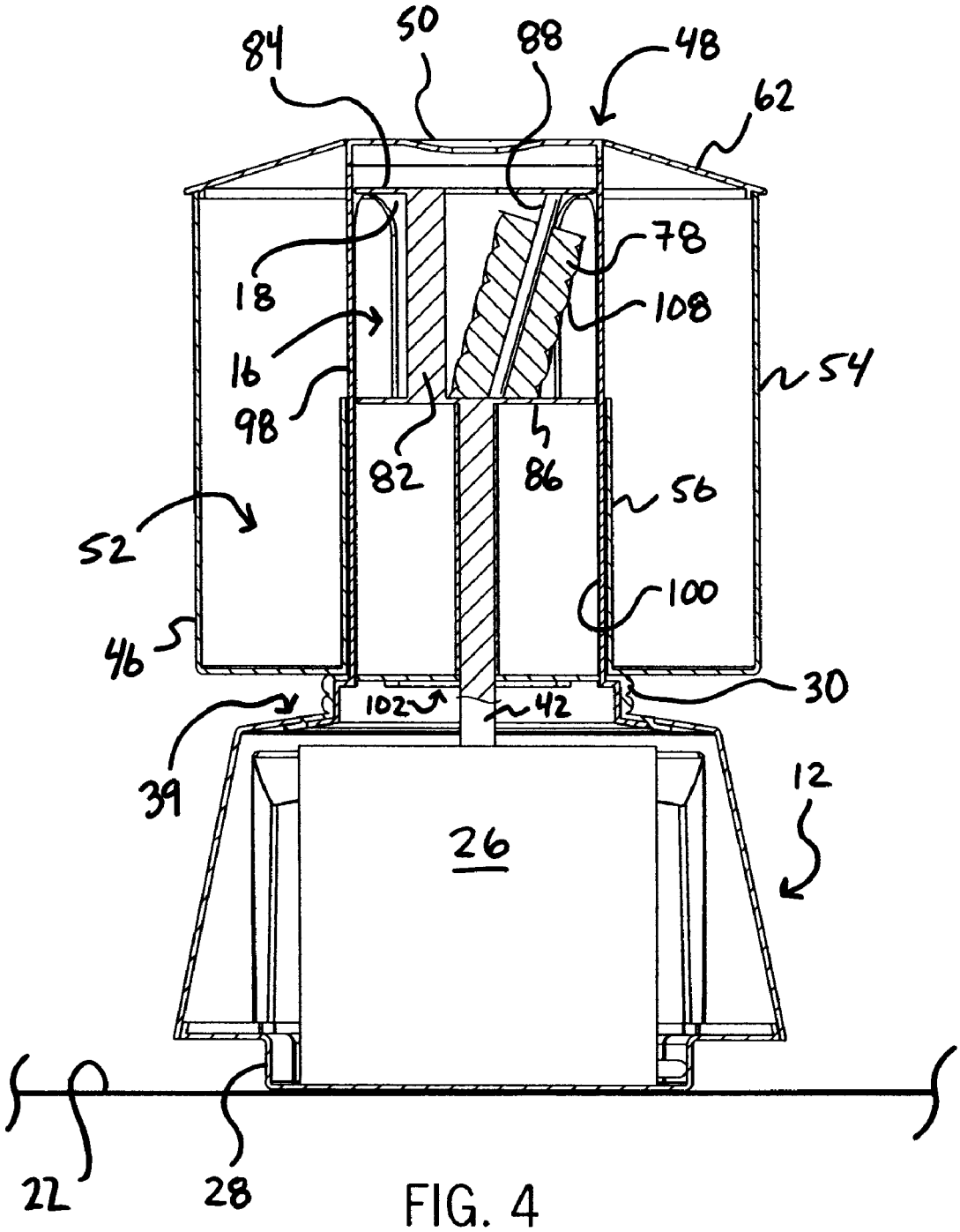
FIG. 4 is a cross-sectional view taken along line 4-4 of FIG. 2.

Referring to FIG. 4, the chamber 52 is defined by an exterior wall 54 and an interior wall 56. The chamber 52 continuously extends around the interior wall 56. Interior wall 56 has a height less than the exterior wall 54 so as to expose the blade assembly in order to allow shavings to enter chamber 52. Wall 56 should be as high as possible in order to create the largest holding space for the pencil shavings while still permitting substantially all shavings to exit the blade assembly and 16 and be captured by the receptacle 46. The edge 58 defines an aperture 60 in the receptacle 46. The receptacle 46 may be made from a variety of light-weight materials. A translucent plastic material is preferred for cosmetic reasons, which include a visible coated blade 78. A translucent receptacle 46 also allows the consumer to know when the sharpening-device 10 needs to be emptied.

The housing cover 48 is semi-saucer shaped and has a sloping surface 62 extending downward from an aperture defining edge 64 to an exterior edge 66. Any other shape suitable to the physical and aesthetic design of the device 10 may be used for a cover 48. The cover 48 is preferably made from a light-weight material such as plastic. The cover 48 may also be a translucent plastic material.

Securably attached to the cover 48 is a pencil guide 50. The pencil guide 50 is a circular-shaped insert for providing a guiding means to pencils 68 (See FIG. 7) as the user inserts them into the device 10. The guide 50 has an exterior edge 70, a pencil-guiding aperture 72 defined by an edge 74, and a recessed surface 76. The guide is positioned such that the guide edge 70 and cover edge 64 are in direct contact with each other.

Figure 5:
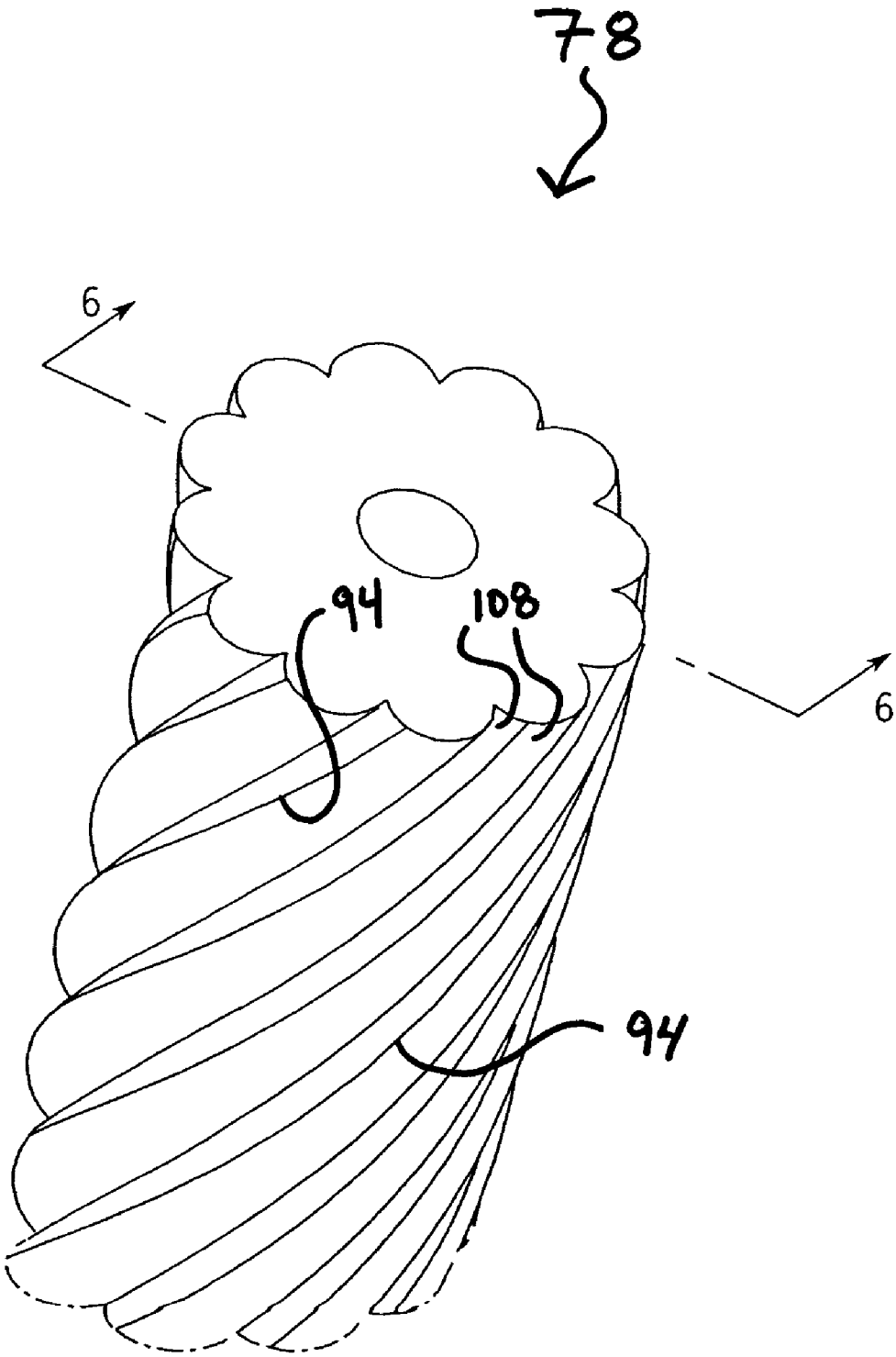
FIG. 5 is an enlarged perspective view of a pencil-sharpening device blade, according to one embodiment of the invention.
Figure 6:
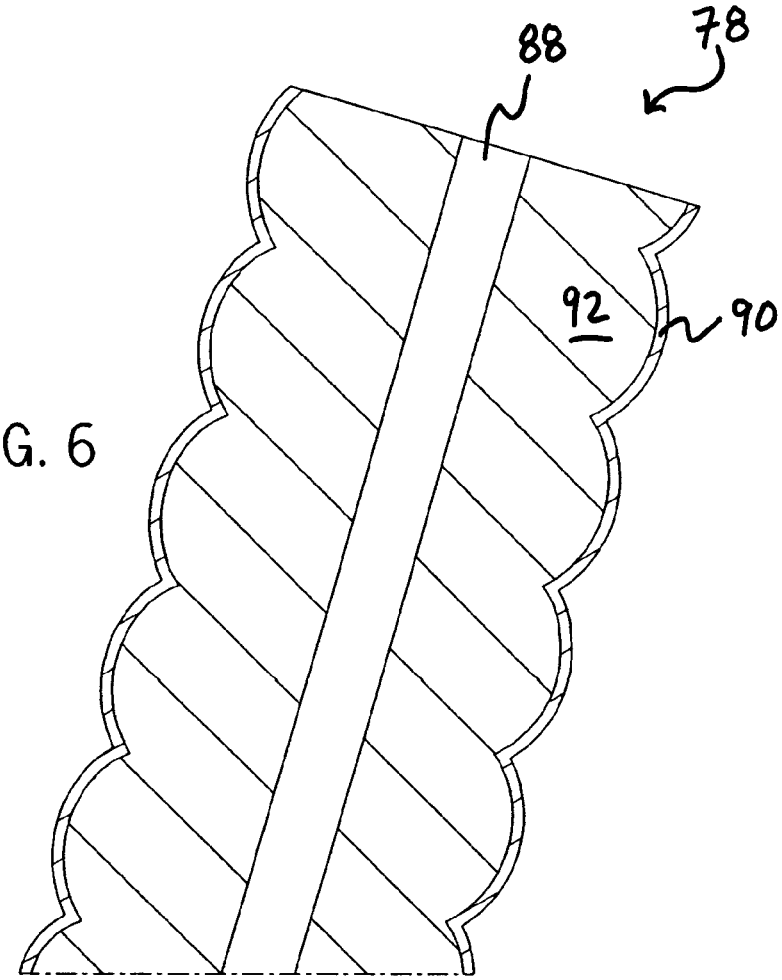
FIG. 6 is a cross-sectional view of the pencil-sharpening device blade taken along line 6-6 of FIG. 5.
Figure 7:
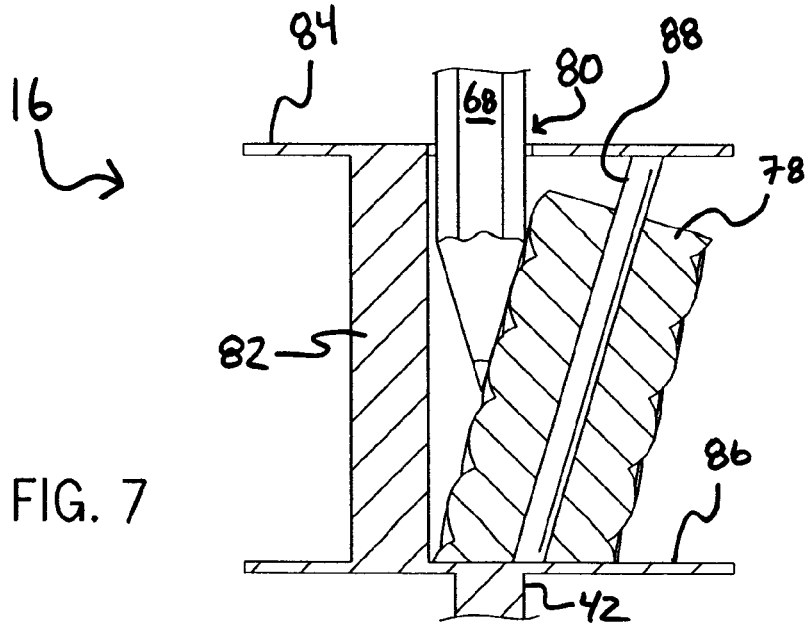
FIG. 7 is a partial exploded view of the pencil-sharpening assembly of FIG. 4, the assembly is shown with a pencil inserted in the device.

Referring to FIGS. 5-7, the blade assembly 16 has a blade 78, pencil guide edge 80, a pencil support 82, rotation gearing (not shown) and a first and second blade assembly support 84, 86. The blade 78 is positioned with respect to the blade assembly by a blade shaft 88. The blade 78 has a coating 90, which is metallurgically bonded to the underlying blade substrate 92. Blade 78 has a plurality of spiral cutting surfaces 94 formed along the longitudinal periphery of the blade. The long axis of the blade 78 is positioned at an angle with respect to the longitudinal sharpening axis, formed from the shaft 42, about which the blade assembly 16 rotates in a manner such that the blade 78 turns about its own axis counter-rotatively with respect to the blade assembly 16 as the blade rotates about its own axis. The axis of the blade is formed by the shaft 88. The spiral shaped blade 78 is not intended to be a limiting factor, but it is also conceived that alternative embodiments may employ a conical blade, a flat blade, or a pair of blades.

The shaft 42 is in communication with both the assembly 16 and blade shaft 88 through gearing (not shown). Rotation of the blade assembly 16 and blade 78 can be performed by various known rotation means.

The pencil guide edge 80 defines an aperture through which the pencil 68 is inserted when the user intends the pencil 68 to be sharpened. The guide edge 80 and edge 74 (See FIG. 3) are substantially the same dimensions, defining substantially the same size apertures through which the pencil 68 is inserted. The edges 74, 80 work in concert as a pencil 68 positioning support along with pencil support 82.

Pencil support 82 is a columnular-shaped and extends from first support 84 to second support 86. Support 82 also provides support to the blade assembly 16. Edges 74, 80 and support 82 are disposed in a manner to provide support to an inserted pencil 68 as it is going through the sharpening process. Spatial positioning of the edges 74, 80 and support 82 are preferred for a pencil 68 of standard dimensions. It is conceived that the spatial representation of edges 74, 80 and support 82 may be expanded or reduced for the purpose of sharpening a variety different shaped pencils. It is further conceived that the edges 74, 80 and support 82 may be dynamically connected so as to provide a pencil sharpening device that can sharpen a variety of different sized pencils 68.

Now referring to FIGS. 3 and 4, an assembly spacer 18 has a base 96, column 98, and insert 100. The base 96 is circular and slightly larger in diameter to the column 98. Column 98 is integral with the base 96 and insert 100. Insert 100 has a shaft guide 102 and plurality of extensions 104. Insert 100 and has a central shaft guide 102 through which the shaft 42 extends. The plurality of extensions 104 extend from the central shaft guide 102 to a plurality of wall sections 106 of the column 98. Insert 100 is disposed within the hollow column 98. The assembly spacer 18 is preferably manufactured from light-weight plastic or an alternative material known in the art.

A cross-sectional depiction of the device 10 as assembled is shown. The power cord 20 and motor assembly 26 are affixed to the motor assembly base 28. Housing spacer 30 is fitted over the assembly spacer 18 such that housing spacer 30 is in direct contact with assembly spacer base 96. The blade assembly 16 placed in rotationally loose communication with and inside of the assembly spacer column 98. The blade assembly is placed atop the assembly spacer insert 100 as the shaft 42 is inserted within shaft guide 102 until it is placed in communication with the motor assembly 26. The base 12 comes is fixedly attached to the motor assembly base 28 as the assembly spacer 18 extends through an aperture of the base 12 defined by edge 39. The receptacle 46 is placed over the assembly spacer 18 such that the receptacle 46 is placed in tight communication with the housing spacer 30 and such that the inner wall 50 is placed in close contact with assembly spacer column 98. The guide 50 is positioned such that the guide edge 70 and cover edge 64 are in direct contact with each other. Housing cover 48 is then placed in releasably tight communication with receptacle 46. After assembly of the device 10 has been completed the power cord 20 or alternative electric power means is engaged the device is ready to sharpen pencils 68.

Now referring to FIG. 6, the device 10 includes a coating 90 disposed on the blade surface 108. Coating 90 provides cutting edges 94 with tough, hard, and wear resistant characteristics. The increased hardness of cutting edges 94 provides blade 78 with substantially increased longevity, while also providing the blade with corrosion resistance, as well as providing a smooth and uniform appearance and color. U.S. Pat. No. 6,988,318, titled "Coating for Cutting Implements" is hereby incorporated by reference. An additional co-pending patent application, having a U.S. application Ser. No. 10/695,429, filed on Oct. 28, 2003 is hereby incorporated by reference.

Coating 90 provides the blade 78 with a smooth wear-resistant surface 108. These advantageous properties act to deter the adherence of graphite particles and pencil shavings to the blade surface 108. Instead of adhering to the blade 78 shortly after being cut away from the pencil 68, the shavings and graphite particles release into the receptacle 46. Resisting the adherence of pencil shavings and graphite particles assists in maintaining the sharpness and longevity of the blade 78.

In addition, coating 90 provides blade 78 with an aesthetically acceptable color or appearance. Specifically, coating 90 differentiates blade 78 having coating 90 from uncoated blades. The blade 78 can be viewed through the translucent receptacle 46 and identified by the consumer as a coated blade 78. However, coating 90 has an appearance sufficient to allow the consumer to recognize that the coating is present on blade 78.

Further, coating 90 increases the ease of use of pencil-sharpening device 10 by providing at least one blade 78 with a smooth surface finish, which reduces friction between the blade 78 and pencil 68 during use. Thus, blade 78 and pencil 68 have less friction between the two, which provides a smoother cutting action, less cutting effort, and a reduced likelihood of a less than smooth sharpened pencil 68 tip than in coated blades without coating 90. In an alternative embodiment the device 10 includes a pair of coated blades (not shown), which provide a smooth cutting action and have less friction between the blades and a pencil.

Coating 90 is selected from the group consisting of titanium nitride (TiN), chromium nitride (CrN), and titanium chromium nitride (TiCrN). Alternatively, the coating 90 is a multiple component barrier of titanium chromium nitride. The coating 90 alternatively comprises titanium nitride, chromium nitride, and titanium chromium nitride.

Coating 90 is disposed on blade 78 such that the coating forms a metallurgical bond with the blade 78, which resists flaking, blistering, chipping, and peeling. In fact, coating 90 is adsorbed into the surface layer of the metal of blade 78. Coating 90 is disposed on blade 78 with a thickness in a range between about 0.3 and 0.5 microns, more preferably about 0.4 microns.

The coating can be deposed by a first process known as reactive magnetron sputtering with a pulsed dc source. Alternatively the coating is deposed by a second process known as a cathode arc plasma (CAP) process. The sputtering gas mixture in each process is argon and nitrogen. It is conceived that any physical vapor deposition (PVD) process known in the art may be used for coating the blade 78.

In the first process, a four-inch circular target is used with a pulsed dc power supply. The target was a combination target having one or more 90-degree sections of pure titanium and chromium. Alternatively, the target is three 90-degree sections of pure titanium and one 90-degree section of pure chromium.

In the second process, two different targets are used simultaneously, with each target being pure titanium and chromium.

The partial pressure of argon during the first process was maintained between 0 to 1 millitorr and that of nitrogen was maintained at 1 to 2 millitorr with the total sputtering gas pressure maintained between 2 to 3 millitorr. The stainless steel chamber was evacuated to $2\times10^{-5}$ Torr prior to the deposition. Cleaning of the target was carried with argon alone. The sputtering current was kept at 0.3 amps during cleaning that was carried out for 3 minutes in all depositions. Deposition of the films on the blades during cleaning was prevented by a shutter that was withdrawn soon after cleaning the target. The sputtering current was chosen at two different values, 0.5 amperes and 0.7 amperes. Depositions were performed for two different total sputtering times, 15 minutes and 30 minutes. The resulting thickness of the films was found to be 0.3 micrometers and 0.6 micrometers, respectively. The deposition temperature has been optimized for the following conditions. Stainless steel blades should not soften and therefore deposition temperature was kept at a temperature of about 150° and 200° C.

The hardness of the samples was measured using a Vickers microhardness test according to American Society of Testing and Materials (ASTM) E384, last revised March 2001. Here, a diamond indenter is loaded to a desired amount, which causes the indenter to indent the sample. The indentation is measured and converted to a hardness value. The indenter is a four-sided, pyramid-shaped diamond probe tip with angle of 136°.

The coated blade 78 is generally harder than an uncoated blade. The hardness tends to increase as the level of chromium is increased. Additionally, the satin silver appearance generally tends to increase as the content of chromium increases.

However, blades 78 having a more balanced amount of titanium to chromium have a satin silver appearance. Here, it has been determined that consumers recognized pencil sharpener blades 78 having a satin silver appearance as being for general household use and as having a coating.

Chromium is typically about 2.5 times more expensive than titanium. Thus, forming coating 90 of a majority of chromium leads to a substantial increase in cost, with only minimal gains in hardness. For example, coating 90 having 75% chromium and 25% titanium is about 95% as hard as a coating of 100% chromium.

It has also been found that the chromium nitride forms a strong bond to the blade, but does not form a strong bond with itself. For example, chromium nitride can form a strong bond with the chromium oxide of blade 78, but does not form a strong bond with other chromium nitride molecules. Thus, the samples having a majority of chromium exhibited a higher tendency to peel than other samples having a minority of chromium.

The diffusion barrier properties exhibited by the samples having a majority of titanium were superior to those having less titanium. Thus, the samples having a majority of titanium exhibited better stain and corrosion resistance than other samples having a minority of titanium.

Coating 90 having the desired hardness, smoothness, and diffusion barrier properties preferably is formed of titanium chromium nitride having about 35 percent by weight of titanium nitride and about 65 percent by weight of chromium nitride and with a hardness in a range of about 5.7 to about 9.1 gigapascals. More preferably, coating 90 has about 50 percent by weight of titanium nitride and about 50 percent by weight of chromium nitride and a hardness in a range of about 7.2 to about 7.6 gigapascals.

It has been determined that coating 90 having the aforementioned ratios of chromium nitride and titanium nitride provided the pencil-sharpening device blade 78 with a visual indication that the coating had been applied, without affecting the consumer's impression of the target use of the device (i.e., general household use). Moreover, coating 90 having the aforementioned ratios of chromium nitride and titanium nitride provided blade 78 with drastically improved hardness over the uncoated blades (not shown).

The surface roughness of blade 78 before and after the application of coating 90 was also measured. For example, the surface roughness of the surface of blade 78 before coating 90 was in a range of about 20 to $25\times10^{-6}$ inch/inch, but was reduced to about 15 to $20\times10^{-6}$ inch/inch after the coating was applied. It is believed that the roughness of blade 78 was reduced because the molecules of coating 90 predominantly bond with the valleys and indentations in the blade 78.

Of course, it should be recognized that blade 78 is described above by way of example only as having a coating applied by reactive magnetron sputtering and CAP processes. Any thin film forming method such as chemical vapor deposition, physical vapor deposition, thermal spraying and sintering after a dip coating may be employed for providing coating 90 to blade 78. Preferably, the method of forming coating 90 has a maximum temperature sufficient to not soften or affect the heat-treatment of the uncoated blades.

It should also be recognized that coating 90 has been described above by way of example only as finding use with a pencil-sharpening device blade having a plurality of spiral shaped cutting surfaces. Blade 78 is preferably made of steel, more preferably stainless steel, such as 420 stainless steel. In addition, blade 78 can be heat-treated to further increase hardness.

The device 10 may be used for sharpening a variety of writing instruments, including but not limited to crayons, pencils, and any other reusable writing instruments that utilizes a volume reducing tip.

It should also be noted that the terms "first", "second", and "third" and the like may be used herein to modify various elements. These modifiers do not imply a spatial, sequential, or hierarchical order to the modified elements unless specifically stated.

While the invention has been described with reference to one or more exemplary embodiments, it will be understood by those skilled in the art that various changes may be made and equivalents may be substituted for elements thereof without departing from the scope of the invention. In addition, many modifications may be made to adapt a particular situation or material to the teachings of the disclosure without departing from the essential scope thereof. Therefore, it is intended that the invention not be limited to the particular embodiment(s) disclosed as the best mode contemplated for carrying out this invention, but that the invention will include all embodiments falling within the scope of the appended claims.

What is claimed is:

1. A device comprising:

a pencil sharpener blade having a cutting edge; and a coating comprising titanium nitride and chromium nitride metallurgically bonded to the pencil sharpener blade, the coating having a thickness in a range of about 0.3 to about 0.5 microns, comprising less than, equal to or about 50 percent by weight of titanium nitride and greater than, equal to or about 50 percent by weight of chromium nitride, and providing the blade with a satin silver appearance, wherein the titanium nitride and the chromium nitride are not isolated in different regions of the coating, and wherein the coating consists essentially of nitrides of titanium and chromium.

2. The device according to claim 1, wherein the metallurgically bonded coating is resistant to flaking, blistering and chipping.

3. The device according to claim 2, wherein the metallurgically bonded coating is resistant to peeling.

4. The device according to claim 1, wherein the coating provides the blade with corrosion resistance.

5. The device according to claim 1, wherein the coated blade has a surface roughness in the range of about 15 to $20\times10^{-6}$ inch/inch.

6. The device according to claim 1, wherein the coated blade is mounted in a housing.

7. The device according to claim 6, wherein the blade and the housing are configured to sharpen a writing instrument.

8. The device according to claim 1, wherein the nitrides of titanium and nitride include titanium chromium nitride.

9. A device comprising:

a pencil sharpener blade having a cutting edge; and a coating comprising titanium nitride and chromium nitride disposed on the pencil sharpener blade, the coating comprising less than, equal to or about 50 percent by weight of titanium nitride and greater than, equal to or about 50 percent by weight of chromium nitride, wherein the titanium nitride and the chromium nitride are not isolated in different regions of the coating, and wherein the coating consists essentially of nitrides of titanium and chromium.

10. The device according to claim 1, wherein the coating provides the blade with a satin silver appearance.

11. The device according to claim 1, wherein the nitrides of titanium and chromium include titanium chromium nitride.

12. The device according to claim 1, wherein the coating is disposed on the cutting blade such that the coating forms a metallurgical bond with the blade, wherein the metallurgical bond is resistant to flaking, blistering, chipping, and peeling.

13. The device according to claim 1, wherein the coating comprises greater than, equal to or about 75 percent by weight chromium nitride.

14. The device according to claim 1 further comprising a device housing, wherein the device housing comprises a base structure and a repository structure.

15. The device according to claim 14, wherein the repository structure is an opaque chamber with a transparent viewing window.

16. The device according to claim 1, wherein the coating is resistant to flaking, blistering and chipping.

17. The device according to claim 1, wherein the coating provides the blade with corrosion resistance.

18. The device according to claim 1, wherein the coated blade has a surface roughness in the range of about 15 to $20\times10^{-6}$ inch/inch.

* * * * *

UNITED STATES PATENT AND TRADEMARK OFFICE

CERTIFICATE OF CORRECTION

PATENT NO. : 7,934,319 B2
APPLICATION NO. : 11/557806
DATED : May 3, 2011
INVENTOR(S) : Peterson et al.

It is certified that error appears in the above-identified patent and that said Letters Patent is hereby corrected as shown below:

Column 8:
Line 50, delete "nitride" (first occurrence) and insert --chromium--.
Line 62, delete "claim 1" and insert --claim 9--.
Line 64, delete "claim 1" and insert --claim 9--.
Line 66, delete "claim 1" and insert --claim 9--.

Column 9:
Line 3, delete "claim 1" and insert --claim 9--.
Line 6, delete "claim 1" and insert --claim 9--.

Column 10:
Line 1, delete "claim 1" and insert --claim 9--.
Line 3, delete "claim 1" and insert --claim 9--.
Line 5, delete "claim 1" and insert --claim 9--.

Signed and Sealed this
Ninth Day of August, 2011

David J. Kappos

David J. Kappos
*Director of the United States Patent and Trademark Office*